US009097073B2

(12) United States Patent
Schmidt et al.

(10) Patent No.: US 9,097,073 B2
(45) Date of Patent: Aug. 4, 2015

(54) DUAL STRING SECTION MILL

(75) Inventors: Ronald G. Schmidt, Tomball, TX (US); Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 541 days.

(21) Appl. No.: 13/492,016

(22) Filed: Jun. 8, 2012

(65) Prior Publication Data

US 2012/0325480 A1 Dec. 27, 2012

Related U.S. Application Data

(60) Provisional application No. 61/495,724, filed on Jun. 10, 2011.

(51) Int. Cl.
*E21B 29/00* (2006.01)
*E21B 10/32* (2006.01)

(52) U.S. Cl.
CPC ..... *E21B 10/32* (2013.01); *E21B 29/005* (2013.01)

(58) Field of Classification Search
CPC ... E21B 10/322; E21B 29/007; E21B 29/002; E21B 29/005; E21B 10/32
See application file for complete search history.

(56) References Cited

U.S. PATENT DOCUMENTS

| | | | | |
|---|---|---|---|---|
| 4,938,291 | A * | 7/1990 | Lynde et al. | 166/55.8 |
| 5,014,780 | A | 5/1991 | Skipper | |
| 5,074,355 | A | 12/1991 | Lennon | |
| 5,899,268 | A | 5/1999 | Lynde et al. | |
| 6,125,929 | A | 10/2000 | Davis et al. | |
| 6,920,923 | B1 | 7/2005 | Pietrobelli et al. | |
| 7,823,632 | B2 | 11/2010 | McAfee et al. | |
| 8,141,634 | B2 | 3/2012 | Fisher et al. | |
| 2005/0274546 | A1 | 12/2005 | Fanuel et al. | |
| 2009/0266544 | A1 | 10/2009 | Redlinger et al. | |
| 2010/0089583 | A1 | 4/2010 | Xu et al. | |
| 2011/0220357 | A1 * | 9/2011 | Segura et al. | 166/298 |
| 2012/0152543 | A1 | 6/2012 | Davis | |

FOREIGN PATENT DOCUMENTS

| | | |
|---|---|---|
| RU | 56931 | 9/2006 |
| SU | 926233 | 7/1982 |
| WO | 2010054407 | 5/2010 |

OTHER PUBLICATIONS

International Search Report and Written Opinion of PCT Application No. PCT/US2012/041537 dated Oct. 4, 2012: pp. 1-7.

* cited by examiner

*Primary Examiner* — Nicole Coy

(57) ABSTRACT

A dual string section milling tool includes a cutting block deployed in an axial recess in a tool body. The cutting block is configured to extend radially outward from and retract radially inward towards the tool body. The cutting block is further configured to remove a cement layer in a wellbore. The dual string section milling tool further includes a milling blade deployed in an axially slot disposed in the cutting block. The milling blade is configured to extend radially outward from and inwards towards the cutting block. The milling blade is further configured to cut and mill a section of casing string. The dual string section milling tool may be further configured to simultaneously remove cement and mill a wellbore tubular.

34 Claims, 14 Drawing Sheets

DUAL STRING SECTION MILL

RELATED APPLICATIONS

This application claims the benefit of U.S. Provisional Application Ser. No. 61/495,724, titled Dual String Section Mill, filed on Jun. 10, 2011, which is incorporated herein by reference in its entirety.

BACKGROUND OF THE INVENTION

Oil and gas wells are ordinarily completed by first cementing metallic casing stringers in the borehole. Depending on the properties of the formation (e.g., formation porosity), a dual casing string may be employed, for example, including a smaller diameter string deployed internal to a larger diameter string. In such dual-string wellbores, the internal string is commonly cemented to the larger diameter string (i.e., the annular region between the first and second strings is filled or partially filled with cement).

When oil and gas wells are no longer commercially viable, they must be abandoned in accordance with local government regulations. These regulations vary from one jurisdiction to another; however, they generally require one or more permanent barriers to isolate the wellbore. In certain jurisdictions, well abandonment requires a length (e.g., about 50 meters) of the wellbore casing string to be removed prior to filling the wellbore with a cement plug. The casing string is commonly removed via a milling operation that employs a downhole milling tool having a plurality of circumferentially spaced milling/cutting blades that extend radially outward from a tool body. During a typical milling operation, the milling tool is deployed on a tool string and rotated in the wellbore such that the blades make a circumferential cut in the metallic casing string. The tool string is then urged downhole while rotation continues so as to axially mill the casing string to the desired length.

While such milling tools are commonly employed in downhole milling operations, their use is not without certain drawbacks. For example, milling a dual-string wellbore typically requires the tool string to be tripped out of the wellbore after milling the smaller diameter string so as to install larger diameter blades. A separate drilling operation may also be required to remove the cement layer located between the inner and outer strings. These multiple operations and trips are both time consuming and expensive and therefore are undesirable.

The use of larger diameter milling blades can also be problematic in that the larger blades are subject to increased shear and torsional loads and therefore more prone to failure (e.g., via fracturing or circumferentially wrapping around the tool body). Moreover, for this reason, the use of larger diameter milling blades does not generally enable simultaneous removal of the cement layer and one or both of the casing strings. Larger diameter blades are also difficult to fully collapse into a tool body. Hence, tripping a tool having larger diameter blades can be problematic as the larger blades may hang up in smaller diameter casing (even when collapsed into the tool body).

As a result, there is a need for a milling tool capable of being deployed in a dual-string wellbore in a single trip, and preferably capable of simultaneously removing a cement layer and milling at least one casing string.

SUMMARY OF THE INVENTION

The present disclosure addresses one or more of the above-described drawbacks of the prior art. One or more embodiments include a casing section milling tool (e.g., a dual string casing mill) having at least one milling structure. The at least one milling structure includes a cutting block deployed in an axial recess in a tool body. The cutting block is configured to extend radially outward from and retract radially inward towards the tool body. The cutting block is further configured to remove a cement layer in a wellbore. The milling structure further includes a milling blade deployed in an axially slot disposed in the cutting block. The milling blade is configured to extend radially outward from and inwards towards the cutting block. The milling blade is further configured to cut and mill a section of a casing string in a wellbore.

In one embodiment, the cutting block and milling blade are configured to extend in first, second, and third stages. In the first stage, the cutting block extends outward from the tool body while the milling blade remains retracted, or substantially retracted, within the cutting block. In the second stage, the cutting block continues to extend outward from the tool body while a first axial end portion of the milling blade pivots radially outward from the cutting block. This pivoting action is intended to bring an outer cutting surface of the milling blade into contact with a casing string. In the third stage, the cutting block continues to extend outward from the tool body while a second opposing axial end portion of the milling blade extends outward from the cutting block.

Exemplary embodiments of the present disclosure provide several technical advantages. For example, one or more embodiments enable the simultaneous removal of a cement layer and the milling of an outer casing string in certain dual-string wellbores. Such simultaneous actions save time and reduce operational costs. Moreover, the configuration of the milling structure in which a milling blade extends radially outward from a cutting block reduces loads on the milling blades and thereby improves the reliability and durability of the tool in service.

One or more embodiments may also include distinct cutting structures for removing a cement layer and milling an outer casing string. The use of distinct cutting structures advantageously allows such cutting structures to be tailored so as to most efficiently remove cement and/or remove casing. For example, the cutting block may be configured for removing cement while the milling blade is configured for milling steel. Thus, an optimal performance for cement removal and casing milling may be achieved while ensuring that the respective cutting structures have a suitably long service life.

In one or more embodiments, a milling tool (i.e., a casing section mill or a dual string section mill) is disclosed, which includes at least one cutting block deployed in an axial recess disposed in a tool body of the milling tool. The tool body has a central axis therethrough and is configured to couple with a tool string. The at least one cutting block is arranged and designed to extend radially outward relative to the central axis of the tool body to a cutting block extended position and retract radially inward from the cutting block extended position towards the central axis of the tool body. At least one milling blade is deployed in an axial slot disposed in the cutting block. The at least one milling blade is arranged and designed to extend radially outward from the cutting block to a milling blade extended position and retract radially inward from the milling blade extended position towards the cutting block.

In one or more embodiments, a milling tool (i.e., a casing section mill or a dual string section mill) is disclosed, which includes a cutting block deployed in a recess disposed in a tool body of the milling tool. The tool body has a central axis therethrough and is configured to couple with a tool string. The cutting block is configured to extend radially outward relative to the central axis of the tool body to a cutting block extended position and retract radially inward from the cutting block extended position towards the central axis of the tool body. A milling blade is deployed in a slot disposed in the cutting block and is configured to extend radially outward from the cutting block to a mill blade extended position and retract radially inward from the milling blade extended position towards the cutting block. A spring is deployed in the tool body and is configured to bias the cutting block in a first axial direction. The spring bias also biases the cutting block radially inward towards the tool body. A piston is deployed in the tool body and is configured to urge the cutting block in a second axial direction against the bias of the spring. The piston is responsive to a differential hydraulic pressure in the tool body.

One or more methods for substantially simultaneously removing a cement layer and milling a casing string in a wellbore are also disclosed. In one method of the present disclosure, a milling tool is rotated at a starting downhole position in a well bore. The milling tool includes a cutting block deployed in a tool body and a milling blade deployed in the cutting block. The cutting block is arranged and designed to extend radially outward from a central axis of the tool body and the milling blade is arranged and designed to extend radially outward from the cutting block. The cutting block is extended radially outward from the central axis of the tool body while the milling blade remains retracted in the cutting block. At least a portion of a cement layer on an inner surface of an outer casing string at the starting downhole position is removed with the cutting block in its extended position. A first axial end portion of the milling blade is pivoted radially outward from the cutting block. The outer casing string is cut with the first axial end portion of the milling blade in its extended position. A second axial end portion of the milling blade is extended radially outward from the cutting block. At least a portion of the outer casing string at the starting downhole position is removed with the second axial end portion of the milling blade in its extended position. The milling tool is urged in a downhole direction while the cutting block and the milling blade remain extended, such that translation of the milling tool in the downhole direction causes the cutting block and the milling blade to simultaneously remove cement layer and mill outer casing string.

This summary has broadly introduced several features and technical advantages of one or more embodiments in order that the detailed description of the embodiments that follow may be better understood. This summary is not intended to identify key or essential features of the claimed subject matter, nor is it intended to be used as an aid in limiting the scope of the claimed subject matter. Additional features and advantages of one or more embodiments will be described hereinafter. Furthermore, those skilled in the art will also appreciate that the specific embodiments disclosed may be readily utilized as a basis for additional modifications for carrying out the same purposes of the disclosed subject matter. Such additional constructions do not depart from the spirit and scope of the present disclosure.

BRIEF DESCRIPTION OF THE DRAWINGS

For a more complete understanding of the present disclosure, and the features and advantages of embodiments disclosed herein, reference is now made to the following detailed description taken in conjunction with the accompanying drawings, in which.

DETAILED DESCRIPTION

Figure 1:
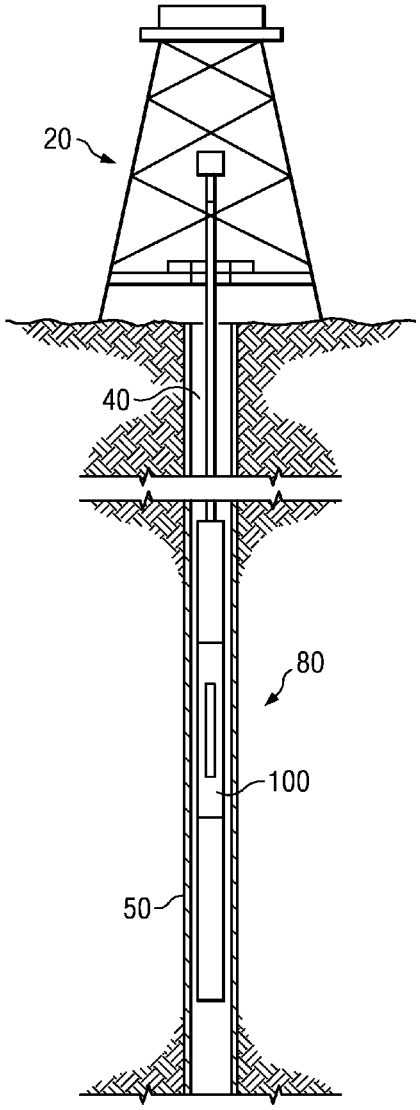
FIG. 1 depicts a conventional drilling rig on which exemplary downhole tool embodiments in accordance with the present disclosure may be utilized.

With respect to FIGS. 1 through 8D, it will be understood that features or aspects of the one or more embodiments illustrated may be shown from various views. Where such features or aspects are common to particular views, they are labeled using the same reference numeral. Thus, a feature or aspect labeled with a particular reference numeral on one view in FIGS. 1 through 8D may be described herein with respect to that reference numeral shown on other views.

FIG. 1 depicts one exemplary embodiment of a downhole tool 100 (i.e., a casing section mill or a dual string section mill) deployed in a cased wellbore 40. In FIG. 1, a rig 20 is positioned in the vicinity of a subterranean oil or gas formation. The rig 20 may include, for example, a derrick and a hoisting apparatus for lowering and raising various components into and out of the wellbore 40. The wellbore 40 is at least partially cased with a string of metallic liners 50. A tool string 80 including a downhole tool 100, configured in accordance with the present disclosure, is depicted as being run into the wellbore. Downhole tool 100 includes at least one cutting block and milling blade combination (not shown) that is configured for milling the casing string 50. It will be understood that tool string 80 may include other suitable components and other downhole tools as needed for a particular downhole operation and that the embodiments disclosed herein are not limited to any particular rig configuration, derrick, or hoisting apparatus.

Figure 2A:
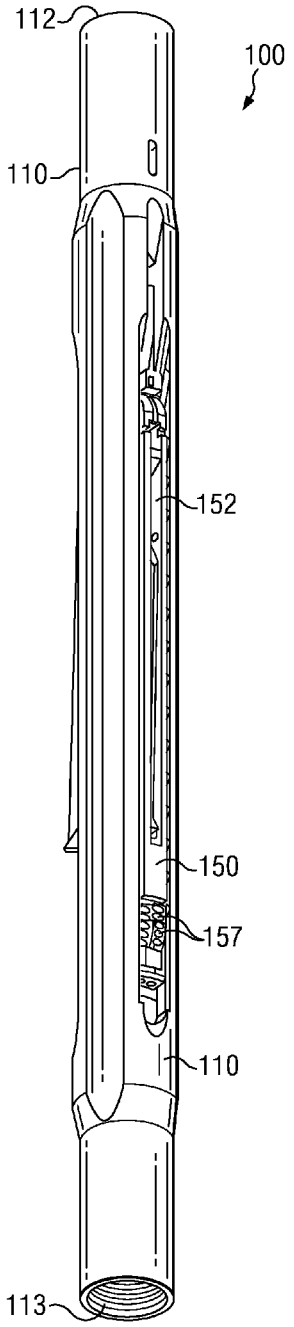
FIG. 2A depicts a perspective view of one exemplary embodiment of a downhole tool in accordance with the present disclosure.
Figure 2B:
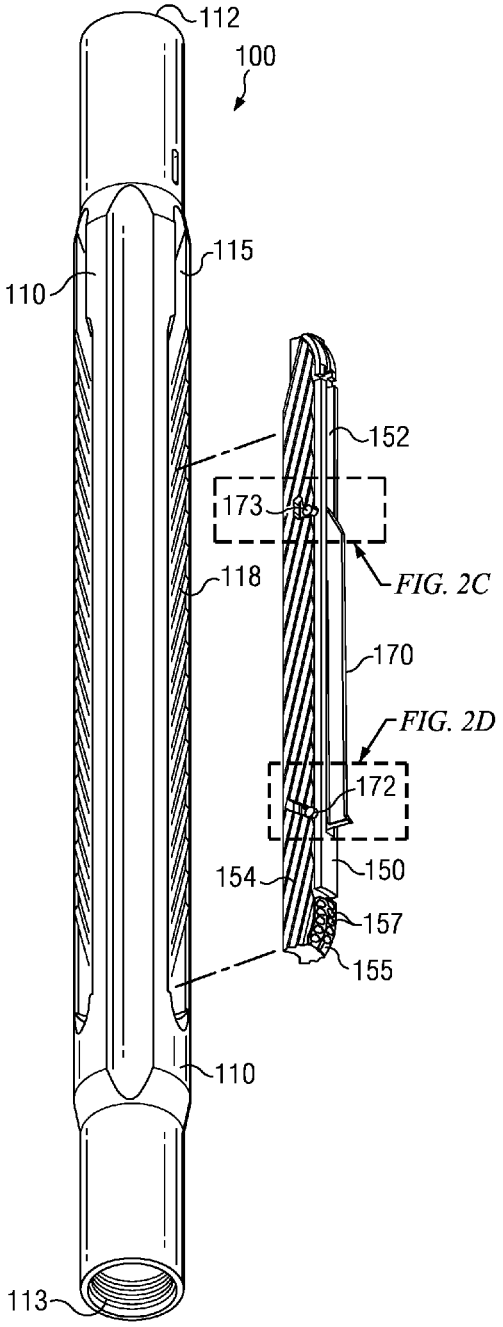
FIG. 2B depicts a partially exploded view of the downhole tool embodiment depicted on FIG. 2A.
Figure 2C:
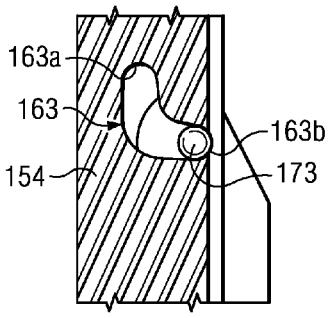
FIGS. 2C and 2D depict first and second portions of a cutting block portion of the downhole tool embodiment depicted on FIG. 2B.

FIGS. 2A and 2B depict perspective and partially exploded views of downhole tool 100. In the exemplary embodiment depicted, downhole tool 100 includes a tool body 110 including uphole and downhole threaded end portions 112 and 113 suitable for coupling with a drill string (or other tool string). A plurality of circumferentially-spaced cutting blocks 150 are deployed in corresponding axial recesses 115 disposed or formed in the tool body 110. The cutting blocks 150 are configured to move between radially retracted (as depicted on FIG. 2A) and radially extended positions as described in more detail below with respect to FIGS. 3A-6C. A milling blade 170 is deployed in an axial slot 152 in each of the cutting blocks 150 and biased radially inward towards the tool axis. The milling blades 170 are also configured to move between radially retracted (as depicted on FIG. 2A) and radially extended positions (FIG. 2B). In the foregoing disclosure, downhole tool 100 is described in more detail with respect to a single cutting block and milling blade. It will be understood by those skilled in the art that tools in accordance with the present disclosure preferably, although not necessarily, include multiple cutting blocks and milling blades.

Cutting block 150 includes a plurality of angled splines 154 formed on the lateral sides thereof. The splines 154 are sized and shaped to engage corresponding angled splines 118 formed on the lateral sides of the axial recess 115. Interconnection between splines 154 and splines 118 advantageously increases the contact surface area between the cutting block 150 and the tool body 110, thereby providing a more robust structure suitable for downhole casing milling and/or cement removal operations. The splines 118, 154 are angled such that the splines 118, 154 are not parallel with a longitudinal or central axis of the downhole tool 100. As such, relative axial motion between the cutting block 150 and the tool body 110 causes a corresponding radial extension or retraction of the block 150. The splines 118, 154 are angled such that the block 150 is radially extended via uphole axial motion of the block 150 with respect to the tool body 110. The splines 118, 154 may be disposed at substantially any suitable angle as the embodiments disclosed herein are not limited in this regard.

In the exemplary embodiment depicted, at least a nose portion 155 of the cutting block 150 is fitted with a plurality of cutting elements 157. In one or more other embodiments, the entire radially facing outer surface (also referred to in the art as the gage surface) of the cutting block 150 may be fitted with cutting elements 157. The embodiments of the present disclosure are not limited with respect to the placement or quantity of cutting elements. Moreover, any cutting elements suitable for milling/removing cement may be utilized including, but not limited to, polycrystalline diamond cutter (PDC) inserts, thermally stabilized polycrystalline (TSP) inserts, diamond inserts, boron nitride inserts, abrasive materials, and other cutting elements known to those skilled in the art. The cutting block 150 may further include various wear protection measures deployed thereon, for example, including the use of wear buttons, hard facing materials, or various other wear resistant coatings. The embodiments of the present disclosure are not limited with respect to the quantity, placement or type of wear protection measures or devices deployed thereon.

Milling blade 170 is deployed in a corresponding axial slot 152 disposed or formed in the cutting block 150. The blade 170 is secured to the cutting block 150 via first and second axially spaced pins 172, 173 (in the exemplary embodiment depicted, the pins 172, 173 are located near the downhole and uphole end portions, respectively, of the blade 170) and biased radially inwards via a spring biasing mechanism, e.g., a spring. As best illustrated on FIGS. 2C and 2D, the pins 172, 173 engage corresponding slots 162, 163, respectively, formed in the lateral sides of the cutting block 150. The slots 162, 163 are shaped such that relative axial motion of the cutting block 150 beyond a predetermined axial location causes a stepwise extension of the milling blade 170 (as described in more detail below). In the exemplary embodiment depicted on FIG. 2C, the second pin 173 engages a curved slot 163 having a first end portion 163*a* that faces (or points or is directed) in the uphole direction and a second end portion 163*b* that faces (or points or is directed) radially outward. Now turning to FIG. 2D, the first pin 172 engages an angled slot 162 (i.e., neither parallel nor perpendicular to the longitudinal axis through tool 100) having radially inner and outer end portions 162*a*, 162*b*. Slot 162 may be substantially perpendicular to the splines 154, for example, as in the depicted embodiment of FIG. 2D (although the disclosed embodiments are not limited in this regard). The angle of slot 162 may be selected so as to predetermine the deployment rate of milling blade 170. A steeper-angled slot 162 causes a more rapid deployment but decreases the necessary wedging action when the blade 170 is extended. Thus, there may be a trade off in selecting the angle between achieving a suitable deployment rate and a sufficient wedging action. A curved slot 162 (not shown) may also be utilized such that the rate of deployment is variable and depends on the degree of deployment (e.g., such that the rate increases with increasing deployment). Again, the embodiments disclosed herein are not limited in these regards.

Those skilled in the art will readily appreciate that the cutting and/or milling surfaces of milling blade 170 may be dressed using any known cutting or other materials in the art. For example, these surfaces may be substantially or heavily hard faced with a metallurgically-applied tungsten carbide material. Other surface treatments may include, for example, disposition of a diamond or cubic boron nitride material, disposition of an embedded natural or polycrystalline diamond, and/or the like. Other suitable surface treatments may be equally employed.

Figure 3B:
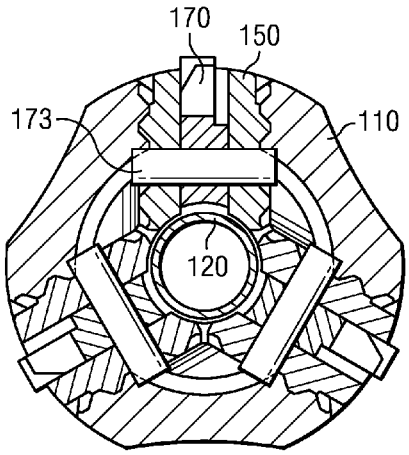
FIGS. 3A, 3B, and 3C (collectively FIG. 3) depict longitudinal and circular cross sectional views of the downhole tool depicted on FIG. 2A in which the cutting block and milling blade are in retracted positions.
Figure 2D:
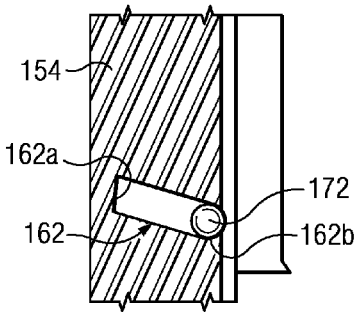
Figure 3C:
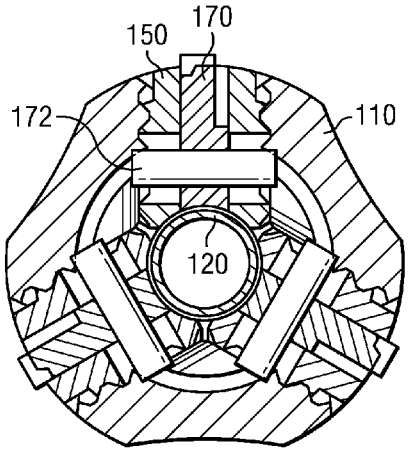
Figure 3A:
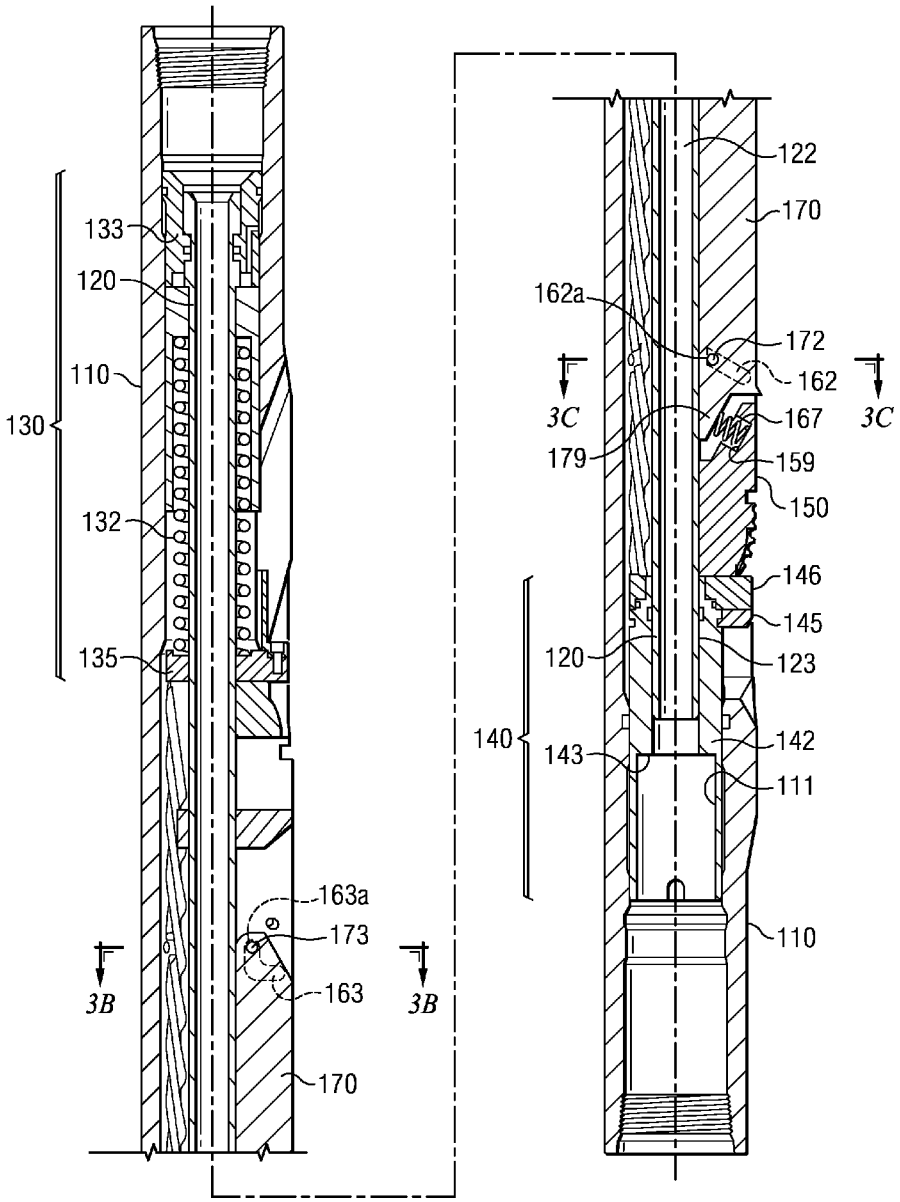

As illustrated on FIG. 3A-C, milling blade 170 is spring biased in the retracted position. Turning now to FIG. 3A, a compression spring 167 is deployed between an internal surface 159 of the cutting block 150 and a wing 179 of the milling blade 170. The spring 167 is angled with respect to the tool axis and therefore biases the blade 170 radially inward and axially uphole with respect to the cutting block 150 such that pin 172 is biased towards end portion 162*a* of slot 162 and pin 173 is biased towards end portion 163*a* of slot 163.

Extension and retraction of the one or more cutting blocks 150 and the one or more milling blades 170 is now described in more detail with respect to FIGS. 3 through 6. FIG. 3A depicts a longitudinal cross sectional view of downhole tool 100 (i.e., milling tool 100) with cutting block 150 and milling blade 170 in a retracted, or substantially retracted, position (while FIGS. 3B and 3C depict circular cross sections of downhole tool 100 through pins 173 and 172 respectively). Cutting block 150 is deployed axially between spring biasing mechanism 130 and hydraulic actuation mechanism 140 that are also deployed in the tool body 110. In the exemplary embodiment depicted, an internal or inner mandrel 120 is deployed in the tool body 110 at a position internal to the spring mechanism 130, the hydraulic mechanism 140, and the cutting block 150. The mandrel 120 includes a central throughbore 122, thereby providing a channel for the flow of drilling fluid/mud through the downhole tool 100. The spring biasing mechanism 130 includes a compression spring 132 deployed about the mandrel 120 and axially between an upper cap 133 and a stop ring 135. The upper cap 133 is rigidly connected with the tool body 110 such that the compression spring 132 is configured to bias the cutting block 150 in the downhole direction. The bias of compression spring 132 also urges the cutting block 150 radially inward (due to the configuration of the angled splines 118, 154).

Hydraulic actuation mechanism 140 is configured to urge the cutting block 150 in the uphole direction against the spring bias when differential fluid pressure is applied to the bore 122 of the milling tool 100. An axial piston 142 is sealingly engaged with an inner surface 111 of the tool body 110 and an outer surface 123 of the mandrel 120. Drilling fluid pressure acts on an axial face 143 of the piston 142, thereby urging it in the uphole direction. The piston 142 engages drive ring 145 and retainer 146 which in turn engage cutting block 150 such that translation of the piston 142 causes a corresponding translation and extension of the cutting block 150.

Hydraulic actuation of the cutting block 150 and milling blade 170 may be initiated using substantially any means known in the art. For example, a conventional ball seat (not shown) may be deployed in the tool string 80 (FIG. 1) below the milling tool. As is known to those skilled in the art, a ball may be dropped from the surface onto the ball seat. The ball provides an obstruction to the flow of drilling fluid through the tool string 80 which causes an increase in the fluid pressure in the downhole tool 100. The pressure increase urges piston 142 uphole against the spring bias, thereby actuating the cutting block 150 and milling blade 170 as described above and in more detail below. Upon completion of the casing milling and/or cement removal operation (or at any other desirable time), the fluid pressure in the downhole tool 100 may be increased above some predetermined threshold so as to shear (release) the ball seat and retract the cutting block 150 and milling blade 170 (via spring force provided by compression spring 132). The cutting block 150 and milling blade 170 may also be retracted by reducing the fluid pressure below a predetermined threshold. It will be understood that the embodiments disclosed herein are in no way limited to the use of a ball seat. Substantially any other actuation means may be utilized, for example, including but not limited to the deployment of a flow nozzle in the lower end portion of the tool body 110.

In one or more embodiments in accordance with the present disclosure, the cutting block 150 and milling blade 170 extend radially outward relative to the central axis of the tool body 110 to extended positions in at least first and second stages. In a first stage, the cutting block 150 extends radially outward relative to the central axis of the tool body 110 towards a first cutting block extended position while the milling blade 170 remains retracted or at least substantially retracted in the cutting block 150, and in a second stage, both the cutting block 150 and milling blade 170 simultaneously extend radially outward relative to the central axis of the tool body 110 until both are extended or at least substantially extended (i.e., the cutting block 150 is in a second cutting block extended position and milling blade 170 is in a milling blade extended position).

In the exemplary embodiment depicted on FIGS. 3-6, the cutting block 150 and milling blade 170 extend radially outward relative to the central axis of the tool body 110 to extended positions in first, second and third stages. In the first stage, the cutting block 150 extends radially outward relative to the central axis of the tool body 110 towards a first cutting block extended position while the milling blade 170 remains retracted or at least substantially retracted in the cutting block 150. In the second stage, cutting block 150 continues to extend radially outward relative to the central axis of the tool body 110 towards a second cutting block extended position while one axial end portion of the milling blade 170 pivots outward beyond the outer surface of the cutting block 150 to a first milling blade extended position. In the third stage, cutting block 150 continues to extend radially outward relative to the central axis of the tool body 110 to a third cutting block extended position while the other axial end portion of the milling blade 170 extends radially outward beyond the outer surface of the cutting block 150 to a second milling blade extended position. The cutting block 150 and milling blade 170 are extended or at least substantially extended at the end of the third stage. These stages are now described in more detail below with respect to FIGS. 4, 5, and 6.

Figure 4A:
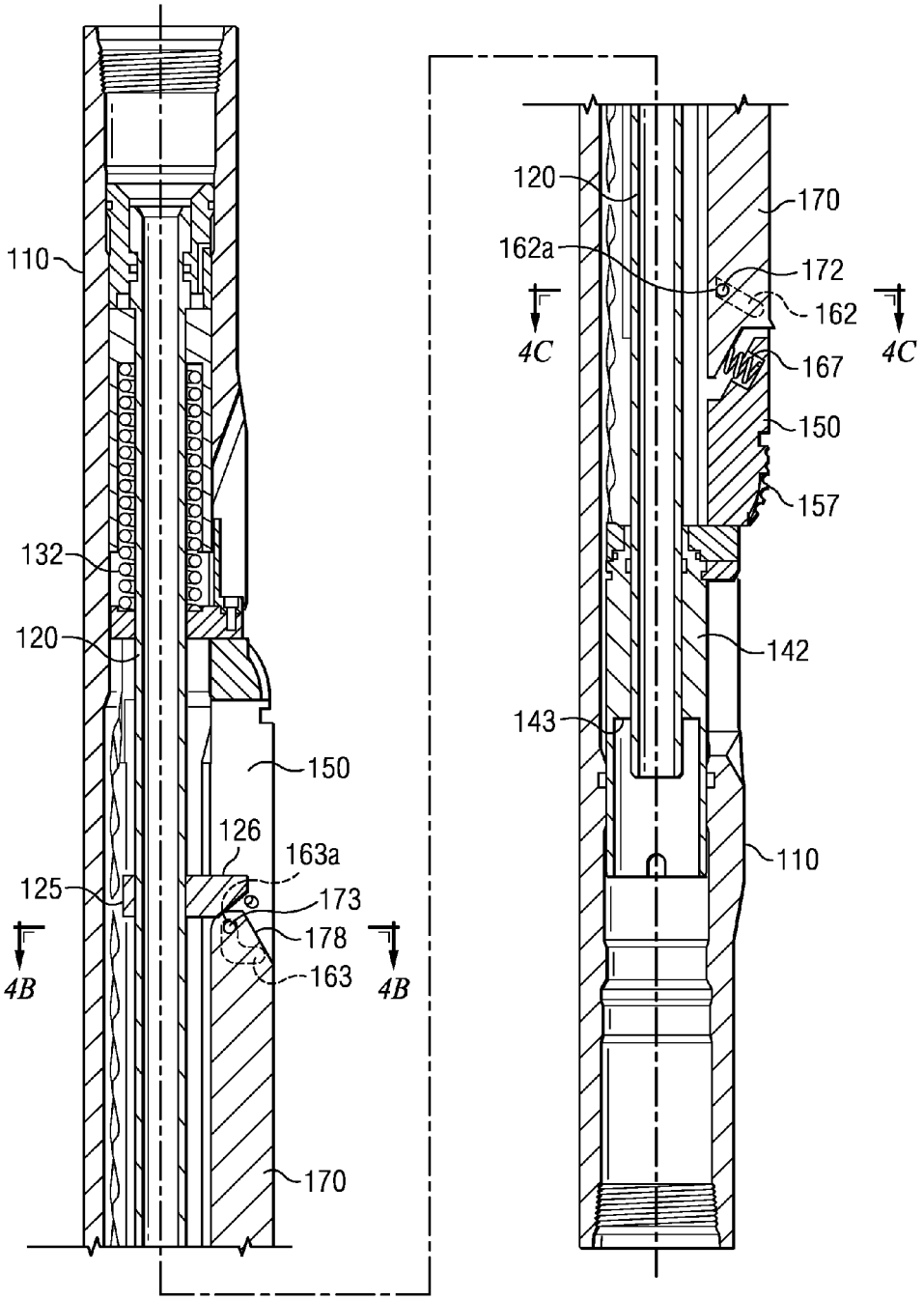
FIGS. 4A, 4B, and 4C (collectively FIG. 4) depict longitudinal and circular cross sectional views of the downhole tool depicted on FIG. 2A in which the cutting block is partially extended and the milling blade is retracted or substantially retracted in the cutting block.
Figure 4B:
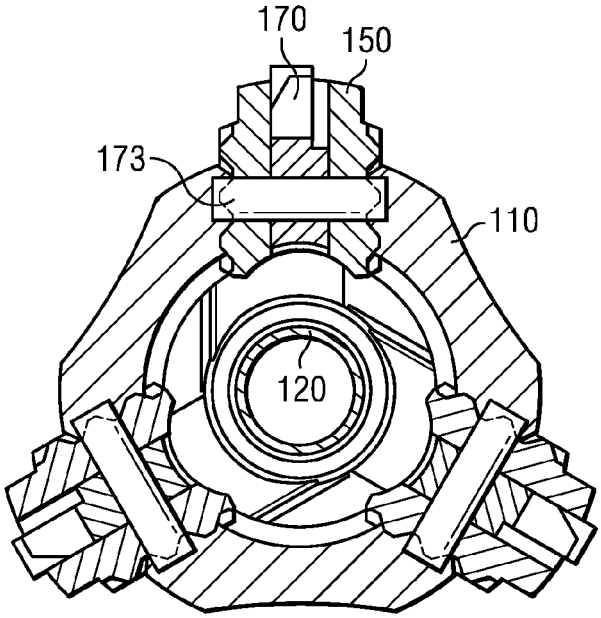
Figure 4C:
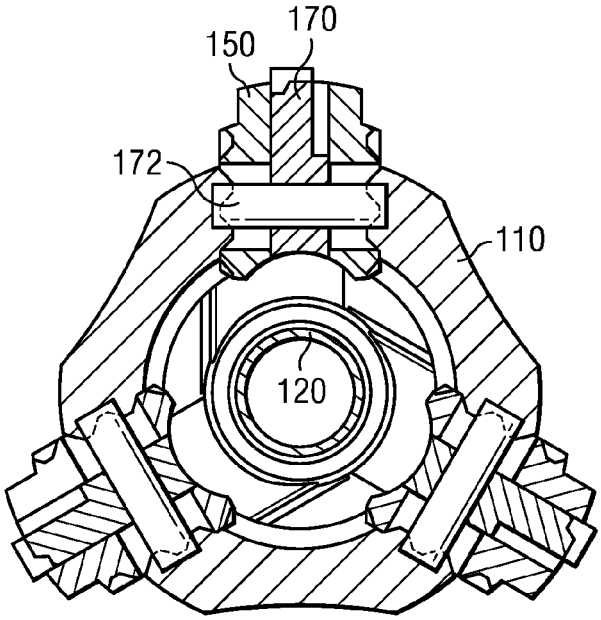

FIGS. 4A, 4B, and 4C depict longitudinal and circular cross sectional views of the milling tool 100 at the end of the first stage. In the first stage, fluid pressure urges piston 142, and therefore cutting block 150, in the uphole direction against the bias of compression spring 132. The engagement of the angled splines 154 and 118 causes the cutting block 150 to extend radially outward as it translates in the uphole direction. Milling blade 170 remains biased in a retracted or at least substantially retracted position in the cutting block 150 with pin 172 engaging inner end portion 162*a* of the angled slot 162 and pin 173 engaging end portion 163*a* of slot 163. At the end of the first stage (as depicted on FIG. 4A), an uphole end portion 178 of the milling blade 170 contacts a radially extending fin 126 of stop ring 125. The stop ring 125 is deployed about and axially secured with the mandrel 120 such that it does not translate with the cutting block 150 and milling blade 170 during hydraulic actuation of piston 142.

Figure 5A:
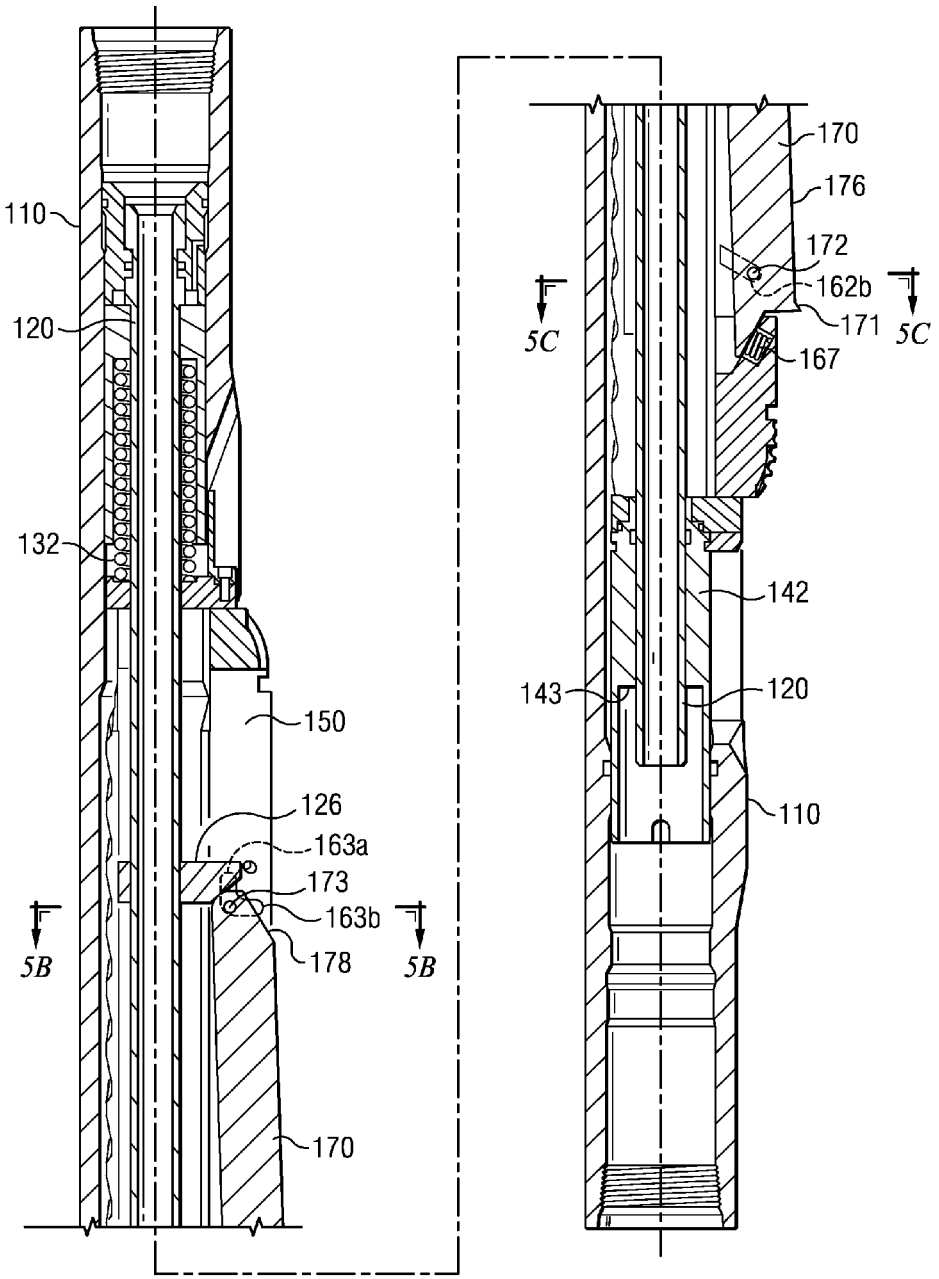
FIGS. 5A, 5B, and 5C (collectively FIG. 5) depict longitudinal and circular cross sectional views of the downhole tool depicted on FIG. 2A in which both the cutting block and the milling blade are partially extended.
Figure 5B:
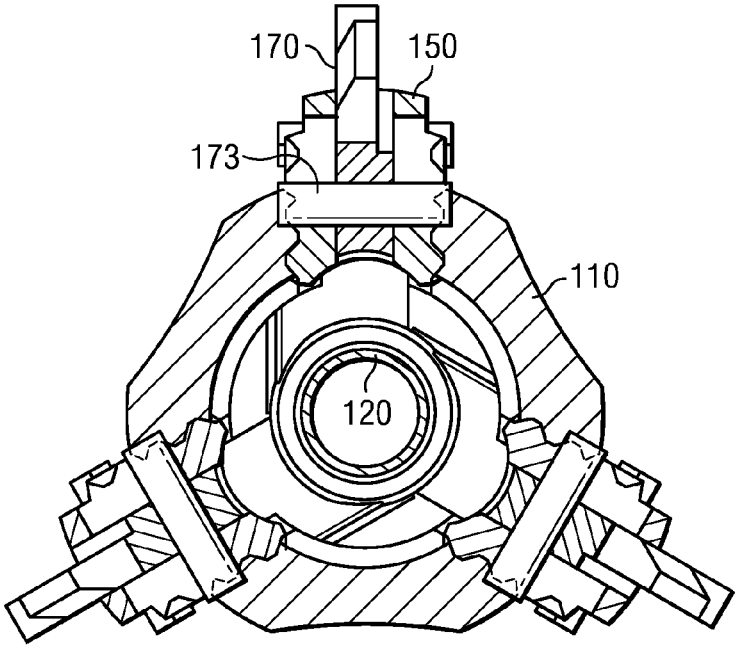
Figure 5C:
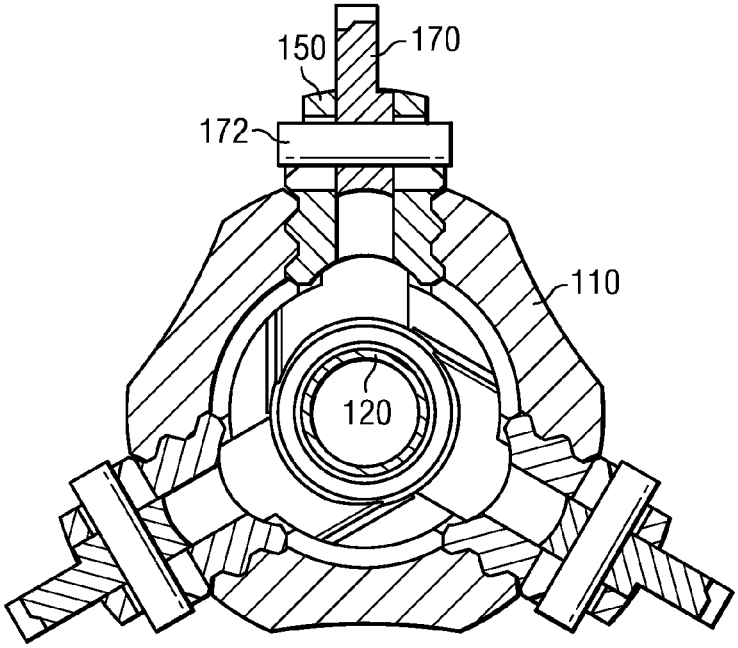

FIGS. 5A, 5B, and 5C depict longitudinal and circular cross sectional views of the milling tool 100 at the end of the second stage. In the second stage, the cutting block 150 continues to translate uphole and radially outward as drilling fluid/mud pressure urges piston 142 in the uphole direction. The milling blade 170 abuts stop ring/member 125 (at fin 126) and is thereby restricted from further translation in the uphole direction. The abutment of the milling blade 170 with the stop ring/member 125 urges the milling blade 170 against its spring bias (via spring 167) as the cutting block 150 continues to translate uphole past the milling blade 170. This in turn causes pin 173 to slide away from end portion 163*a* towards the center (elbow) of slot 163 and pin 172 to slide away from inner end portion 162*a* towards outer end portion 162*b* of angled slot 162. The relative axial motion of the cutting block 150 with respect to the milling blade 170 and the engagement of pins 172 and 173 with corresponding slots 162 and 163 therefore causes the milling blade 170 to pivot such that a downhole end portion 176 of the blade 170 extends radially outward while an uphole end portion 178 of the blade 170 remains retracted radially inward with respect to the cutting block 150. At the end of the second stage (as depicted on FIG. 5A-C), pin 173 is located at the center (the elbow) of slot 163 and pin 172 is located at the outer end portion 162*b* of angled slot 162. In this configuration, the downhole end portion 176 of the blade 170 is extended or at least substantially extended with respect to the cutting block 150, for example, such that cutting surface 171 contacts or penetrates a wellbore casing string (not shown), e.g., to make a circumferential cut therein.

The uphole end portion 178 of the blade 170 remains retracted or at least substantially retracted in the cutting block 150.

Figure 6A:
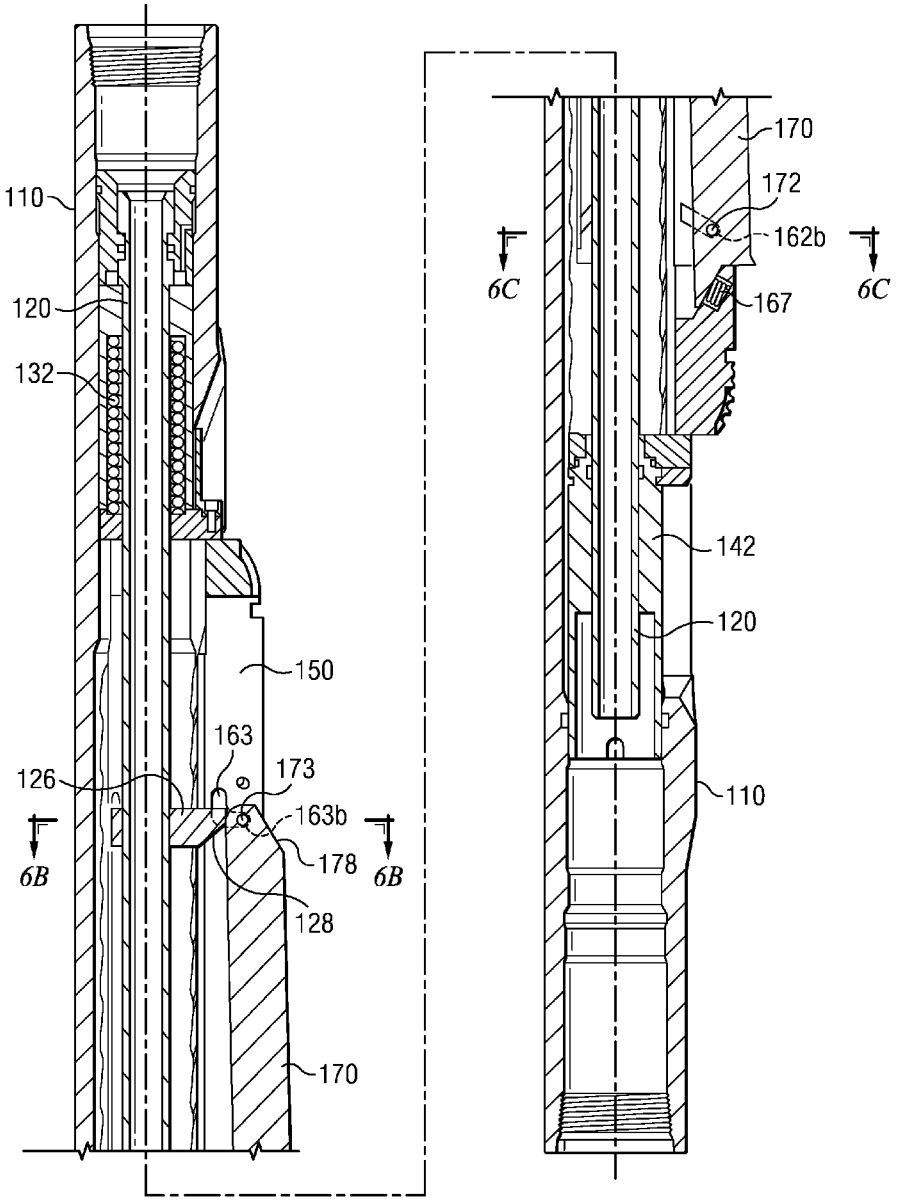
FIGS. 6A, 6B, and 6C (collectively FIG. 6) depict longitudinal and circular cross sectional views of the downhole tool depicted on FIG. 2A in which both the cutting block and the milling blade are in extended positions.
Figure 6B:
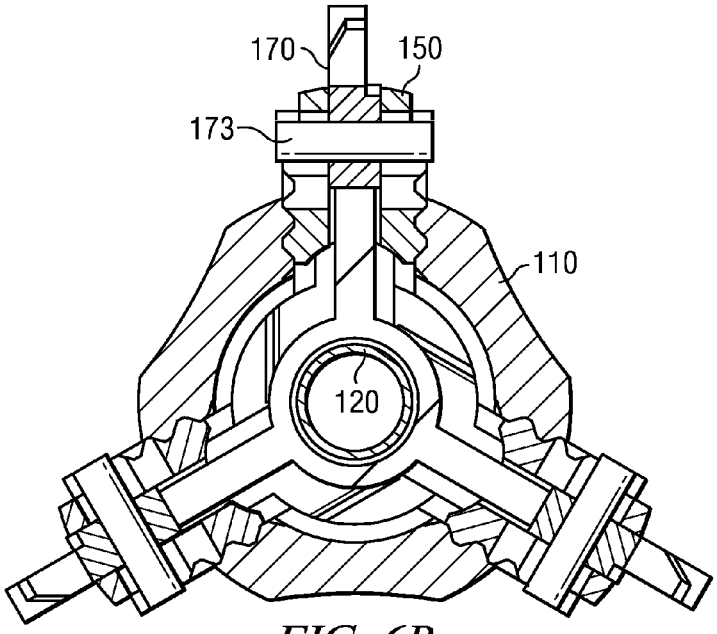
Figure 6C:
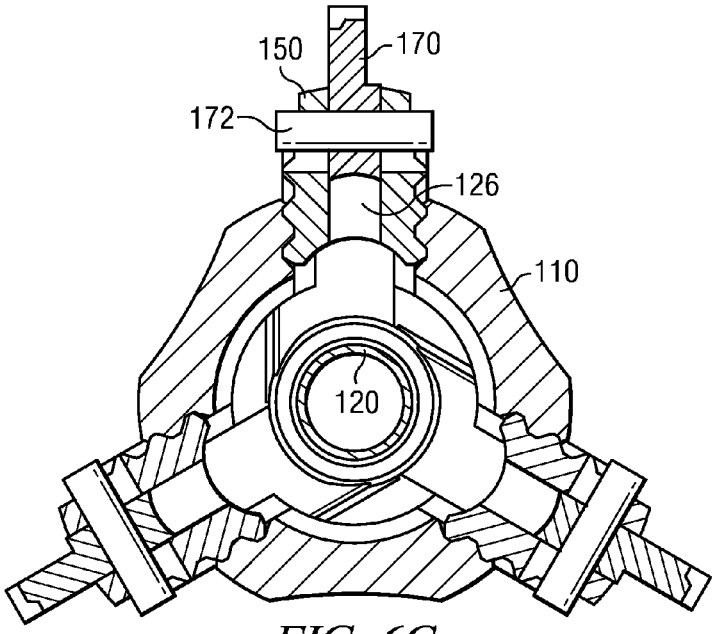

FIGS. 6A, 6B, and 6C depict longitudinal and circular cross sectional views of the milling tool 100 at the end of the third stage at which the cutting block 150 and milling blade 170 are extended or at least substantially extended. In the third stage, the cutting block 150 continues to translate uphole and radially outward as drilling fluid/mud pressure urges piston 142 in the uphole direction. Meanwhile, milling blade 170 again translates axially uphole and radially outward with the cutting block 150 as the uphole end portion 178 of the blade 170 slides up (and along) a ramp 128 on the fin portion 126 of stop ring 125. Pin 173 slides towards end portion 163*b* of slot 163 (radially outward from the elbow portion of the slot 163). At the end of the third stage (as depicted on FIG. 6A-C), pin 173 is located in end portion 163*b* of slot 163 while the uphole end portion 178 of the milling blade 170 is radially supported by fin 126. The downhole end portion 176 of the blade 170 is supported by the wedging action between the pin 172 and angled slot 162. In this configuration, cutting block 150 and milling blade 170 are extended or at least substantially extended with respect to the tool body 110. Compression spring 132 may be selected such that it is substantially fully compressed when the cutting block 150 is extended or substantially extended. Likewise, spring 167 may be similarly selected such that it is substantially fully compressed when the milling blade 170 is extended or substantially extended. The embodiments of the present disclosure are, of course, not limited in these regards.

With further reference now to FIGS. 6B and 6C, it will be understood that the cutting block 150 advantageously provides circumferential support for the milling blade 170 when extended or substantially extended. The milling blade 170 may be thought of as telescoping radially outward from the block 150. Extension of the cutting block 150 outward from the tool body 110 reduces the required extension of the milling blade and thereby reduces milling loads on the milling blade 170. Notwithstanding, support provided by the blocks 150 tends to advantageously minimize structural damage to the blades 170 during casing milling and/or cement removal operations.

Figure 7:
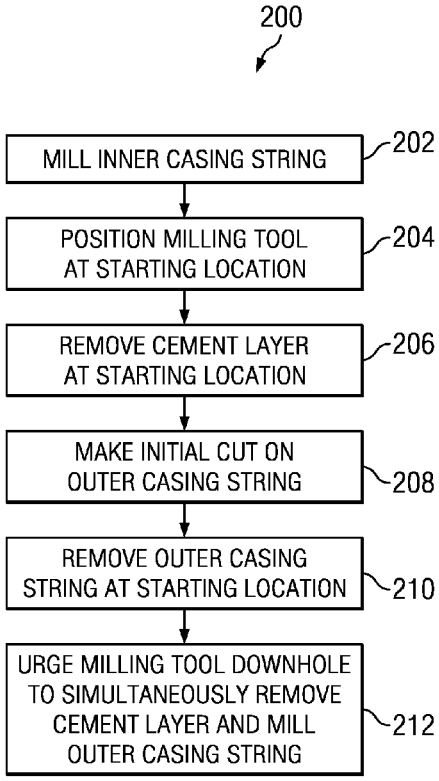
FIG. 7 depicts a flow chart of one exemplary method in accordance with the present disclosure.

While not limited in this regard, milling tool 100 is particularly well-suited for dual string section milling operations. FIG. 7 depicts a flow chart of one exemplary method embodiment 200 for a dual string section milling operation. The exemplary method embodiment 200 depicted includes milling a length of a dual string wellbore including removing the inner and outer casing strings and an annular cement layer located between the strings. In the exemplary embodiment depicted, the inner casing string is first milled at 202, e.g., using a conventional milling tool. After removal of the inner string, milling tool 100 is used to simultaneously remove the annular cement layer and mill the outer casing string in steps 204 through 212. Milling tool 100 is first positioned at a start location/position at 204. The starting location can be the uphole end portion of the borehole section to be milled. The cutting blocks 150 and milling blades 170 are retracted or substantially retracted (as depicted in FIG. 3) while the tool is positioned at 204.

With continued reference to FIG. 7, actuation of milling tool 100 is initiated at 206. The cutting blocks 150 are extended into contact with the annular cement layer while the tool rotates in the borehole. As the cement layer is removed, the cutting blocks 150 continue to extend radially (while the milling blades 170 remain at least partially retracted as depicted on FIG. 4). After the cement layer has been partially or substantially fully removed at the start location, the milling blades 170 begin to pivot radially outward (as depicted on FIG. 5) such that the cutting surface 171 makes an initial cut in the outer casing string at 208. The outer casing is then substantially fully removed at the starting location at 210 as the milling blades 170 are further extended (as depicted on FIG. 6). After removal of the cement layer and the outer casing string at the starting location, the tool string is then urged downhole (while rotating and with the cutting blocks 150 and milling blades 170 extended) so as to simultaneously remove the cement layer and the mill outer casing string at 212. During the milling operation, the nose portion 155 of the cutting block 150 leads the milling blade 170 downhole (i.e., the nose portion 155 of the cutting block 150 is located downhole of the milling blade 170). Such deployment advantageously provides for dual milling functionality in which the cutting block 150 removes the cement layer while the milling blade 170 simultaneously mills the casing string. This deployment also tends to minimize the loading on milling blade 170 as blade 170 is not generally required to simultaneously remove or mill both cement and casing.

Figure 8A:
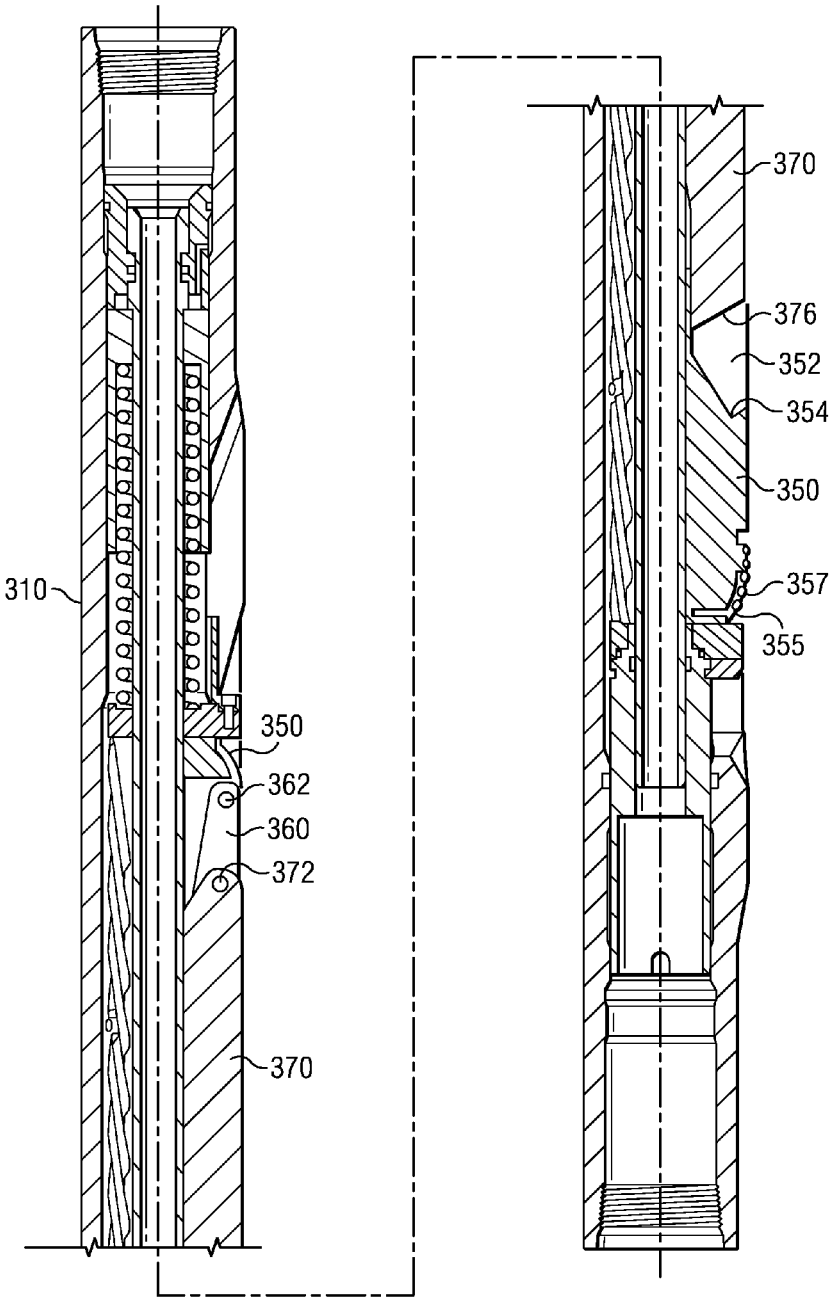
FIG. 8A depicts a longitudinal cross-sectional view of a portion of a downhole tool embodiment of the present disclosure having alternative cutting block and milling blade configurations in which both the cutting block and the milling blade are in retracted positions.
Figure 8B:
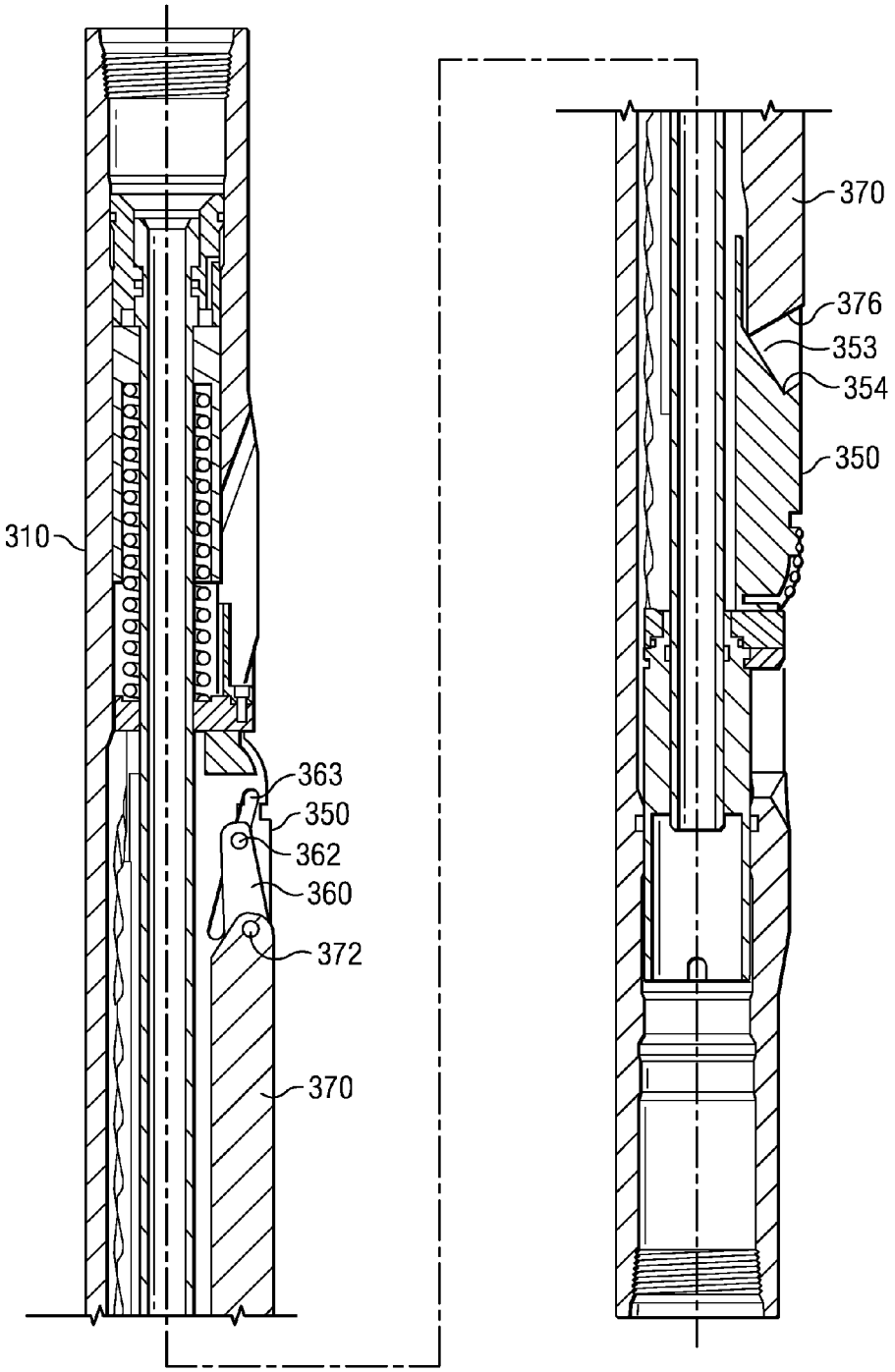
FIG. 8B depicts a longitudinal cross-sectional view of the downhole tool embodiment shown on FIG. 8A in which the cutting block is partially extended and the milling blade is retracted or substantially retracted in the cutting block.
Figure 8C:
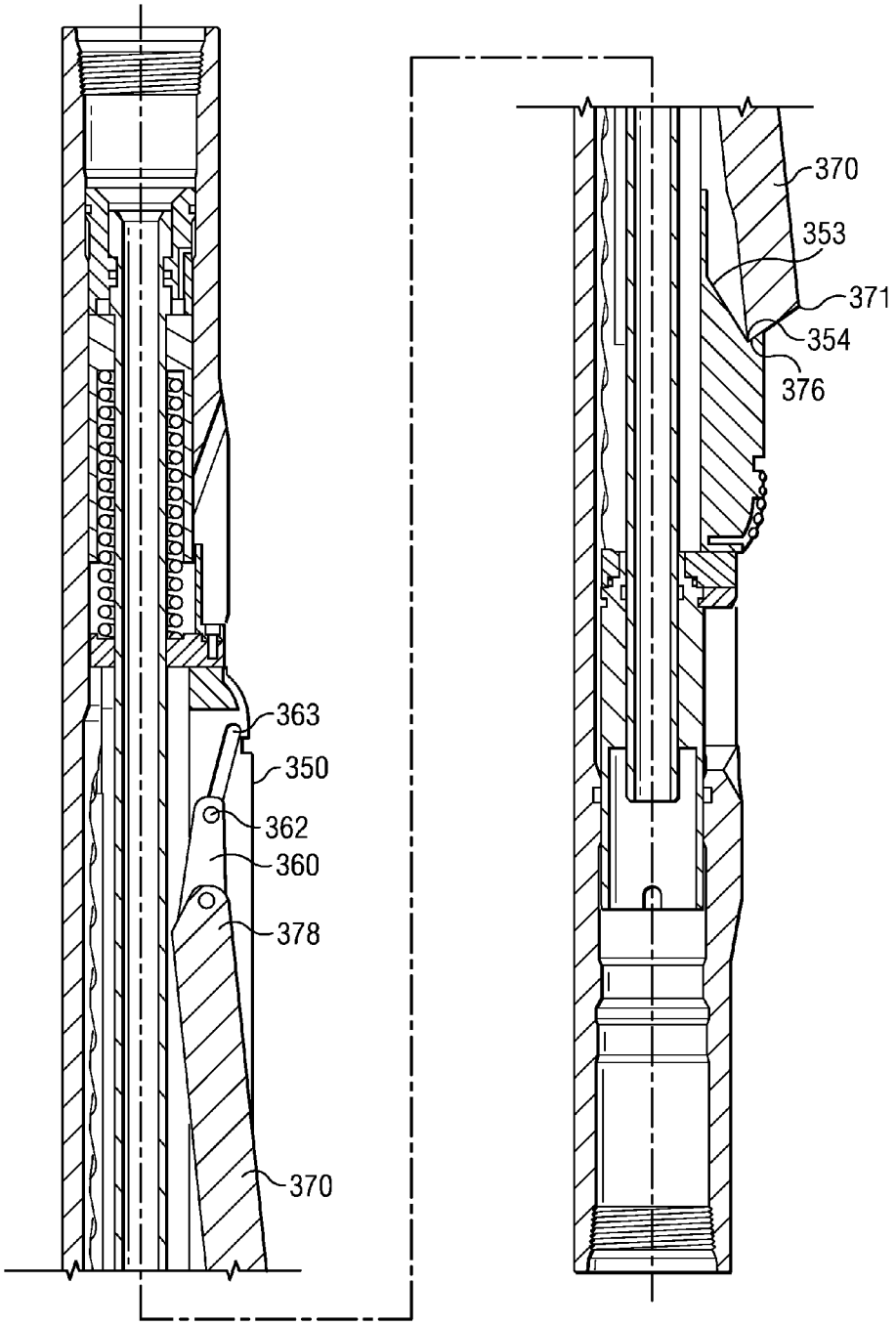
FIG. 8C depicts a longitudinal cross-sectional view of the downhole tool embodiment shown on FIG. 8A in which both the cutting block and the milling blade are partially extended.

FIGS. 8A-D depict longitudinal cross-sectional views of another milling tool embodiment 300 in accordance with the present disclosure. The exemplary embodiment depicted is similar to the downhole tool embodiment 100 described above with respect to FIGS. 2 through 6 with the exception that the downhole tool embodiment 300 of FIGS. 8A-D includes alternative cutting block 350 and milling blade 370 configurations. FIG. 8A depicts a cross-sectional view of milling tool 300 when the cutting block 350 and milling blade 370 are in a collapsed or substantially collapsed position. Milling tool 300 is similar to milling tool 100 in that the cutting block 350 and milling blade 370 extend radially outward in first, second, and third stages. In the first stage, the cutting block 350 extends outward while the milling blade 370 remains retracted or at least substantially retracted in the cutting block 350. FIG. 8B depicts the milling tool 300 at the end of the first stage. In the second stage, cutting block 350 continues to extend outward while one axial end portion of the milling blade 370 pivots outward beyond the outer surface of the cutting block 350. FIG. 8C depicts the milling tool 300 at the end of the second stage. In the third stage, cutting block 350 continues to extend outward while the other axial end portion of the milling blade 370 extends outward beyond the outer surface of the cutting block 350. The cutting block 150 and milling blade 170 are extended or at least substantially extended at the end of the third stage as depicted on FIG. 8D.

Cutting block 350 is similar to cutting block 150 in that it includes a plurality of angled splines (not shown) formed on the lateral sides thereof. Cutting block 350 further includes a plurality of cutting elements 357 formed on a nose portion 355 thereof. The cutting elements may be further deployed on the entire gage surface of the cutting block 350 as described in more detail above. Milling blade 370 is deployed in a corresponding axial slot 352 disposed or formed in the cutting block 350 as described above with respect to milling tool 100. An uphole end portion 378 of the blade 370 is coupled to the cutting block 350 via hinge arm 360. As depicted, the blade 370 is pinned to the hinge arm 360 via pin 372 which is in turn pinned to the tool body 310 via pin 362. Pin 362 extends through an angled slot 363 in the cutting block 350 as described in more detail below.

FIG. 8B depicts the milling tool 300 at the end of the first stage. In the first stage, fluid pressure urges the piston, and therefore the cutting block 350, in the uphole direction against the spring bias. The engagement of the angled splines causes the cutting block 350 to extend radially outward as it translates in the uphole direction as described above. Milling blade 370 remains substantially axially stationary with respect to the tool body 310 and is optionally biased in a retracted or substantially retracted position in the cutting block 350. Cutting block 350 includes an angled slot 363 oriented in the same direction as the angled splines and therefore slides past pin 362 in hinge arm 360 as it translates uphole (and radially outward). At the end of the first stage (as depicted on FIG. 8B), a downhole end portion 376 of the milling blade 370 begins to contact a ramp 353 at the downhole end portion of slot 352.

FIG. 8C depicts the milling tool 300 at the end of the second stage. In the second stage, the cutting block 150 continues to translate uphole and radially outward as drilling fluid/mud pressure urges the piston in the uphole direction. The milling blade 370 continues to remain substantially axially stationary with respect to the tool body 310 as the downhole end portion 376 of the blade 370 slides up the ramp 353. The relative axial motion of the cutting block 350 with respect to the milling blade 370 and the engagement of the blade 370 with the ramp 353 causes the milling blade 370 to pivot about pin 372 in hinge arm 360 such that the downhole end portion 376 of the blade 370 extends radially outward while the uphole end portion 378 of the blade 370 remains retracted radially inward with respect to the cutting block 350. At the end of the second stage (as depicted on FIG. 8C), the downhole end portion 376 of the blade 370 is at the upper end portion of the ramp 353 and engages notch 354 in the cutting block 350. In this configuration, the downhole end portion 376 of the blade 370 is extended with respect to the cutting block 350, for example, such that cutting surface 371 contacts or penetrates a wellbore casing string (not shown). The uphole end portion 378 of the blade 370 remains retracted or at least substantially retracted in the cutting block 350.

Figure 8D:
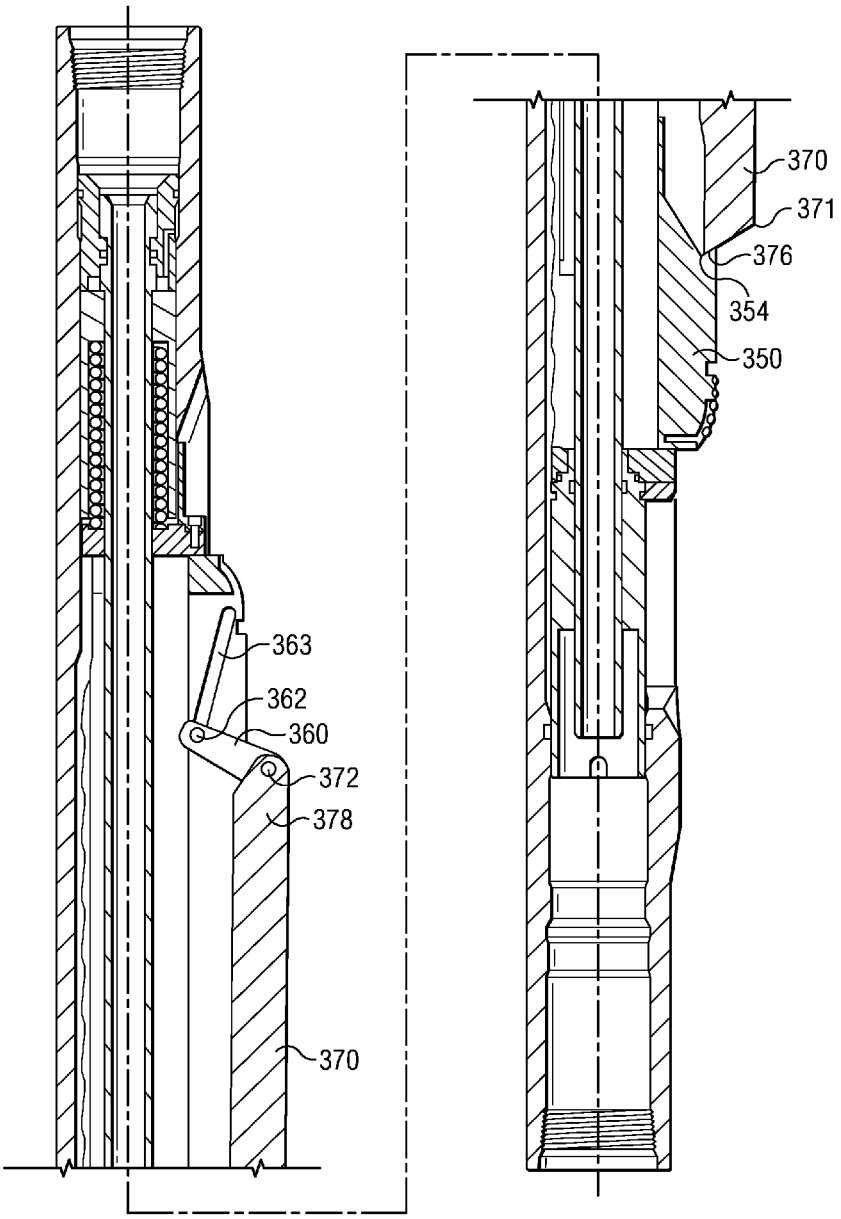
FIG. 8D depicts a longitudinal cross-sectional view of the downhole tool embodiment shown on FIG. 8A in which both the cutting block and the milling blade are in extended positions.

FIG. 8D depicts the milling tool 300 at the end of the third stage at which the cutting block 350 and milling blade 370 are extended or at least substantially extended. In the third stage, the cutting block 350 continues to translate uphole and radially outward as drilling fluid/mud pressure urges the piston in the uphole direction. The milling blade 370 also translates axially uphole and radially outward with the cutting block 350 as the downhole end portion 376 of the blade 370 engages the notch 354. Such engagement and translation of the milling blade 370 causes the uphole end portion 378 of the blade 370 to pivot radially outward on hinge arm 360. At the end of the third stage (as depicted on FIG. 8D), the blade 370 is wedged radially outward. Pin 362 is located at a radially inner and downhole end portion of slot 363 while hinge arm 360 radially supports the uphole end portion 378 of the blade 370. The downhole end portion 376 of the blade 370 is wedged into notch 354. In this configuration, cutting block 350 and milling blade 370 are extended or at least substantially extended with respect to the tool body 310.

It will be understood by those skilled in the art, that in the milling tool embodiment 300, the cutting block 350 and milling blade 370 are advantageously back drivable. By back drivable, it is meant that an uphole force acting on the tool body 310 causes the blade 370 to pivot radially inward as it engages the borehole wall or a narrower section of casing string. Such back drivability advantageously tends to prevent the milling tool 300 from becoming lodged in the wellbore should the cutting block 350 and milling blade 370 retraction mechanism fail in service.

Although only a few example embodiments have been described in detail above, those skilled in the art will readily appreciate that many modifications are possible in the example embodiments without materially departing from the dual string section mill. Accordingly, all such modifications are intended to be included within the scope of this disclosure.

What is claimed is:

1. A milling tool comprising:

a tool body having a central axis therethrough, the tool body configured to couple with a tool string;

at least one cutting block deployed in an axial recess disposed in the tool body;

at least one milling blade deployed in an axial slot disposed in the cutting block; and an actuation mechanism arranged and designed to, while the tool body is in a downhole environment, move the at least one cutting block radially relative to the central axis of the tool body between cutting block retracted and extended positions, and to move the at least one milling blade relative to the central axis of the tool body with the at least one cutting block while the at least one cutting block is moved radially between cutting block retracted and extended positions, and to further move the at least one milling blade relative to the at least one cutting block between mill blade retracted and extended positions.

2. The milling tool of claim 1, wherein the at least one cutting block and the at least one milling blade are arranged and designed to, while in the downhole environment, extend radially outward in first and second stages, the first stage includes the cutting block extending radially outward relative to the central axis of the tool body towards a first cutting block extended position while the milling blade remains at least substantially retracted in the cutting block and the second stage includes the cutting block extending outward relative to the central axis of the tool body to a second cutting block extended position while the milling blade simultaneously extends outward from the cutting block to the milling blade extended position.

3. The milling tool of claim 1, wherein the at least one cutting block and the at least one milling blade are arranged and designed to, while in the downhole environment, extend radially outward in first, second, and third stages, the first stage includes the cutting block extending radially outward relative to the central axis of the tool body towards a first cutting block extended position while the milling blade remains at least substantially retracted in the cutting block, the second stage includes the cutting block extending radially outward relative to the central axis of the tool body towards a second cutting block extended position while a first axial end portion of the milling blade pivots radially outward from the cutting block to a first mill blade extended position, and the third stage includes the cutting block extending radially outward relative to the central axis of the tool body to a third cutting block extended position while a second opposing axial end portion of the milling blade extends radially outward from the cutting block to a second mill blade extended position.

4. The milling tool of claim 1, wherein the at least one cutting block is arranged and designed to provide lateral support for the at least one milling blade when the at least one milling blade is extended radially outward from the cutting block.

5. The milling tool of claim 1, further comprising a plurality of cutting structures deployed on the at least one cutting block, the cutting structures being arranged and designed to remove a cement layer.

6. The milling tool of claim 1, wherein the at least one milling blade is sized and shaped to mill a wellbore casing string.

7. The milling tool of claim 1, wherein the at least one milling blade has a hardened milling surface arranged and designed to mill a wellbore casing string.

8. The milling tool of claim 1, wherein at least three cutting blocks are circumferentially-spaced around the tool body and deployed in corresponding circumferentially-spaced recesses disposed in the tool body, each of the at least three cutting blocks including a corresponding milling blade deployed in an axial slot disposed in each cutting block.

9. A milling tool comprising:

a tool body having a central axis and configured to couple with a tool string;

a cutting block deployed in a recess in the tool body, the cutting block configured to extend radially outward relative to the central axis of the tool body to a cutting block extended position and retract radially inward from the cutting block extended position towards the central axis of the tool body;

a milling blade deployed in a slot in the cutting block, the milling blade configured to extend radially outward from the cutting block to a mill blade extended position and retract radially inward from the mill blade extended position towards the cutting block to a mill blade retracted position, the milling blade being biased towards the cutting block and towards the mill blade retracted position;

a spring deployed in the tool body, the spring biasing the cutting block in a first axial direction, the spring also biasing the cutting block radially inward towards the tool body; and a piston deployed in the tool body, the piston configured to urge the cutting block in a second axial direction against the bias of the spring, the piston being responsive to a differential hydraulic pressure in the tool body.

10. The milling tool of claim 9, wherein the cutting block comprises a plurality of angled splines disposed on lateral sides thereof, the angled splines engaging corresponding angled splines disposed in the recess of the tool body, the angled splines and corresponding angled splines being angled with respect to the central axis of the tool body such that translation of the cutting block in the second axial direction extends the cutting block radially outward relative to the central axis of the tool body.

11. The milling tool of claim 9, wherein the milling blade is coupled to the cutting block via first and second axially-spaced pins, the first pin engaging an angled slot disposed in the cutting block and the second pin engaging a curved slot disposed in the cutting block.

12. The milling tool of claim 9, further comprising a plurality of cutting structures deployed on an outer surface of the cutting block, the cutting structures arranged and designed to remove a cement layer.

13. The milling tool of claim 9, further comprising a plurality of cutting structures deployed on a nose portion disposed on a first axial end portion of the cutting block, the cutting structures arranged and designed to remove a cement layer.

14. The milling tool of claim 9, wherein the milling blade is spring biased radially inward towards the cutting block.

15. The milling tool of claim 9, wherein the milling blade is spring biased both radially inward toward the cutting block and in the second axial direction with respect to the cutting block.

16. The milling tool of claim 9, wherein a first axial end portion of the milling blade includes a cutting surface formed on a radially outer surface thereof, the cutting surface being configured for making a circumferential cut in a wellbore casing string.

17. The milling tool of claim 9, further comprising an inner mandrel having a throughbore configured for transporting fluid through the tool body, the piston being deployed about and in sealingly engagement with a first axial end portion of the inner mandrel and the spring being deployed about a second opposing axial end portion of the inner mandrel.

18. The milling tool of claim 9, wherein the cutting block and the milling blade are configured to extend radially outward in first and second stages, the first stage includes the cutting block extending radially outward relative to central axis of the tool body towards a first cutting block extended position while the milling blade remains at least substantially retracted in the cutting block and the second stage includes the cutting block extending radially outward relative to the central axis of the tool body to a second cutting block extended position while the milling blade simultaneously extends radially outward from the cutting block to the milling blade extended position.

19. The milling tool of claim 9, wherein the cutting block and the milling blade are configured to extend radially outward in first, second, and third stages, the first stage includes the cutting block extending radially outward relative to the central axis of the tool body towards a first cutting block extended position while the milling blade remains at least substantially retracted in the cutting block, the second stage includes the cutting block extending radially outward relative to the central axis of the tool body towards a second cutting block extended position while a first axial end portion of the milling blade pivots outward from the cutting block to a first mill blade extended position, and the third stage including the cutting block extending radially outward relative to the central axis of the tool body to a third cutting block extended position while a second opposing axial end portion of the milling blade extends radially outward from the cutting block to a second mill blade extended position.

20. The milling tool of claim 19, wherein:

the piston is configured to urge the cutting block in the second axial direction in each of the first, second, and third stages, the cutting block being configured to extend radially outward as it translates in the second axial direction relative to the tool body; and the milling blade is configured to remain substantially stationary with respect to the cutting block in the first stage.

21. The milling tool of claim 20, wherein the second axial end portion of the milling blade is configured to abut a stop member during the second stage and remain substantially axially stationary with respect to the tool body while the cutting block continues to translate in the second axial direction relative to the tool body.

22. The milling tool of claim 21, wherein:

the first axial end portion of the milling blade is coupled to the cutting block via a first pin that engages a corresponding angled slot disposed in the cutting block, the angled slot having radially inner and outer end portions; and the first pin is configured to translate from the radially inner end portion of the angled slot to the radially outer end portion of the angled slot during the second stage thereby causing the first axial end portion of the milling blade to pivot radially outward with respect to the cutting block.

23. The milling tool of claim 21, wherein the second axial end portion of the milling blade slides radially outward along a ramp on the stop member during the third stage such that the milling blade translates in the second axial direction with the cutting block.

24. The milling tool of claim 23, wherein:

the second axial end portion of the milling blade is coupled to the cutting block via a second pin that engages a corresponding curved slot disposed in the cutting block, the curved slot having a first end portion that points in the second axial direction and a second end portion that points radially outward;

the second pin is configured to translate from the first end portion of the curved slot to an elbow region of the curved slot during the second stage; and the second pin is configured to translate from the elbow region to the second end portion of the curved slot during the third stage.

25. The milling tool of claim 24, wherein:

the engagement of the second pin with the curved slot causes the second end portion of the milling blade to remain retracted radially inward towards the cutting block during the second stage; and the translation of the second pin from the elbow region to the second end portion of the curved slot allows the second end portion of the milling blade to extend radially outward with respect to the cutting block during the third stage.

26. The milling tool of claim 9, wherein the cutting block and the milling blade are configured to extend radially outward in at least first and second stages, the first stage includes the cutting block extending radially outward relative to the central axis of the tool body towards a first cutting block extended position while the milling blade remains at least substantially retracted in the cutting block, the second stage includes the cutting block extending radially outward relative to the central axis of the tool body towards a second cutting block extended position while a first axial end portion of the milling blade slides radially outward from the cutting block along a ramp disposed in a first end portion of the slot.

27. The milling tool of claim 26, wherein towards the end of the second stage, the first axial end portion of the milling blade engages a notch disposed in the cutting block at a radially outer end portion of the ramp.

28. The milling tool of claim 27, wherein the cutting block and the milling blade are configured to extend radially outward in a third stage, the third stage includes the milling blade translating with the cutting block and the second axial end portion of the milling blade pivoting radially outward from the cutting block on a hinge arm while the first axial end portion of the milling blade remains engaged with the notch.

29. The milling tool of claim 9, further comprising a hinge arm pinned to the tool body and to a second axial end portion of the milling blade.

30. The milling tool of claim 29, wherein the hinge arm is pinned to the tool body through an angled slot in the cutting block.

31. The milling tool of claim 30, wherein:

the cutting block comprises a plurality of angled splines formed on lateral sides thereof, the splines engaging corresponding splines formed in the recess, the splines and corresponding splines being angled with respect to the central axis of the tool body such that translation of the cutting block in the second axial direction extends the cutting block radially outward from the tool body; and the angled splines on the cutting block and the angled slot in the cutting block are substantially parallel with one another.

32. A method for substantially simultaneously removing a cement layer and milling a casing string in a wellbore, the method comprising:

rotating a milling tool at a starting downhole position in a well bore, the milling tool including a cutting block deployed in a tool body and a milling blade deployed in the cutting block, the cutting block arranged and designed to extend radially outward from a central axis of the tool body and the milling blade arranged and designed to extend radially outward from the cutting block;

extending the cutting block radially outward from the central axis of the tool body while the milling blade remains at least partially retracted in the cutting block;

removing at least a portion of a cement layer on an inner surface of an outer casing string at the starting downhole position with the cutting block in its extended position;

pivoting a first axial end portion of the milling blade radially outward from the cutting block;

cutting the outer casing string with the first axial end portion of the milling blade in its extended position;

extending a second axial end portion of the milling blade radially outward from the cutting block;

removing at least a portion of the outer casing string at the starting downhole position with the second axial end portion of the milling blade in its extended position; and urging the milling tool in a downhole direction while the cutting block and the milling blade remain extended, translation of the milling tool in the downhole direction causing the cutting block and the milling blade to simultaneously remove cement layer and mill outer casing string.

33. The method of claim 32 further comprising milling an inner casing string in a separate downhole trip prior to removing at least a portion of the cement layer on the inner surface of the outer casing string.

34. The method of claim 33 further comprising milling the inner casing string with a conventional milling tool.

* * * * *